US006037572A

United States Patent [19]

Coates et al.

[11] Patent Number: 6,037,572

[45] Date of Patent: Mar. 14, 2000

[54] THIN FILM HEATING ASSEMBLIES

[75] Inventors: Donald A. Coates, Worthington; Johan Källgren, Columbus, both of Ohio

[73] Assignee: White Consolidated Industries, Inc., Cleveland, Ohio

[21] Appl. No.: 08/800,738

[22] Filed: Feb. 26, 1997

[51] Int. Cl.[7] ..... H05B 3/68; H05B 3/16

[52] U.S. Cl. ..... 219/451.1; 219/465.1; 219/543

[58] Field of Search ..... 219/443, 457, 219/450, 459, 463, 464, 467, 468, 522, 532, 543, 544; 338/327, 328, 330; 126/393, 90 A, 92 A, 19 R

[56] References Cited

U.S. PATENT DOCUMENTS

| | | | |
|---|---|---|---|
| Re. 33,529 | 1/1991 | Cremer et al. . | |
| 2,564,709 | 8/1951 | Mochel | 219/542 |
| 2,678,990 | 5/1954 | Quirk . | |
| 3,412,234 | 11/1968 | Otavka . | |
| 3,465,121 | 9/1969 | Clark . | |
| 3,465,125 | 9/1969 | McArthur, Jr. . | |
| 3,548,154 | 12/1970 | Christiansson | 219/541 |
| 3,624,741 | 11/1971 | Dills | 126/19 R |
| 3,694,627 | 9/1972 | Blatchford et al. | 219/543 |
| 3,800,121 | 3/1974 | Dean et al. . | |
| 3,879,652 | 4/1975 | Billings . | |
| 3,958,172 | 5/1976 | Beck . | |
| 3,981,233 | 9/1976 | Nugarus | 99/422 |
| 4,002,883 | 1/1977 | Hurko | 219/464 |
| 4,055,745 | 10/1977 | Balaguer . | |
| 4,091,144 | 5/1978 | Dresner et al. | 428/328 |
| 4,100,435 | 7/1978 | Komuro . | |
| 4,136,733 | 1/1979 | Asselman et al. . | |
| 4,163,139 | 7/1979 | Malarkey et al. . | |
| 4,167,696 | 9/1979 | Gyursanszky . | |
| 4,195,560 | 4/1980 | DuBois et al. | 99/422 |
| 4,219,857 | 8/1980 | Haraldsson et al. . | |
| 4,298,789 | 11/1981 | Eichelberger et al. . | |
| 4,370,692 | 1/1983 | Wellman, Jr. et al. . | |
| 4,424,439 | 1/1984 | Payne et al. . | |
| 4,443,691 | 4/1984 | Sauer | 219/522 |
| 4,536,645 | 8/1985 | Mio et al. | 338/327 |
| 4,616,125 | 10/1986 | Oppitz . | |
| 4,618,817 | 10/1986 | Holtslander . | |
| 4,816,647 | 3/1989 | Payne . | |
| 4,878,011 | 10/1989 | Holtslander . | |
| 4,885,456 | 12/1989 | Tanaka et al. . | |
| 4,889,974 | 12/1989 | Auding et al. . | |
| 4,897,527 | 1/1990 | Cripps et al. . | |
| 4,900,900 | 2/1990 | Shirae et al. . | |
| 4,956,231 | 9/1990 | Cavezzan et al. | 428/343 |
| 4,960,978 | 10/1990 | Lorenz et al. | 219/455 |
| 4,973,826 | 11/1990 | Baudry et al. | 219/464 |
| 5,051,603 | 9/1991 | Walker . | |
| 5,079,409 | 1/1992 | Takada et al. . | |
| 5,088,389 | 2/1992 | Labadia del Fresno . | |
| 5,164,161 | 11/1992 | Feathers et al. . | |
| 5,182,464 | 1/1993 | Woodworth et al. . | |
| 5,216,303 | 6/1993 | Lu . | |
| 5,221,829 | 6/1993 | Yahav et al. . | |
| 5,235,159 | 8/1993 | Kornrumpf et al. . | |
| 5,245,219 | 9/1993 | Romatzick, Jr. et al. . | |
| 5,293,028 | 3/1994 | Payne . | |
| 5,304,784 | 4/1994 | Tagashira et al. . | |
| 5,367,369 | 11/1994 | Nakai et al. . | |
| 5,410,193 | 4/1995 | Backus et al. . | |
| 5,438,914 | 8/1995 | Höhn et al. . | |
| 5,440,667 | 8/1995 | Simpson et al. . | |
| 5,508,495 | 4/1996 | Yahav et al. | 219/464 |
| 5,577,158 | 11/1996 | K'allgren et al. | 219/543 |
| 5,616,266 | 4/1997 | Cooper | 219/543 |
| 5,665,260 | 9/1997 | Kawada et al. | 219/464 |

*Primary Examiner*—Sang Paik
*Attorney, Agent, or Firm*—Pearne, Gordon, McCoy & Granger LLP

[57] ABSTRACT

Disclosed are heating and warming assemblies including an electrically resistive thin film. The assemblies generally include a planar substrate, a resistive film for heat generation, one or more electrically conductive electrodes in electrical association with the resistive film, and a non-stick layer disposed on the exposed surfaces of the assembly. The heating and warming assemblies according to the present invention are particularly well suited for use in heating devices and appliances such as ranges and griddles. The assemblies are also incorporated into heating panels for ovens.

12 Claims, 10 Drawing Sheets

THIN FILM HEATING ASSEMBLIES

FIELD OF THE INVENTION

The present invention relates to electric heating assemblies comprising a thin resistive film. The present invention assembly finds wide application in cooking appliances and related devices.

BACKGROUND OF THE INVENTION

Film heating elements comprising a layer of an electrically conductive metal are known such as disclosed in U.S. Pat. No. 2,564,709 to Mochel which is herein incorporated by reference. Such film heating elements have typically been used for defrosting circuits on vehicular window assemblies. Other types of film heating devices are known, such as those disclosed in U.S. Pat. No. 4,536,645 to Mio et al., which is herein incorporated by reference.

Film heating elements have not found acceptance within the appliance industry although several film devices have been disclosed such as in U.S. Pat. Nos. 4,889,974 to Auding et al. and 4,298,789 to Eichelberger et al., both of which are herein incorporated by reference. This is believed to result from a lack of reliability and serviceability associated with most contemplated film heating elements. Thus, there is a need for an assembly utilizing a film heating element that is both reliable and serviceable. Furthermore, it would be desirable to provide a film heating assembly that could be readily adapted and utilized in a wide variety of appliance applications.

SUMMARY OF THE INVENTION

The present invention achieves all of the foregoing objectives and provides in one aspect, a heating assembly comprising a planar substrate, a thin electrically resistive film disposed on the substrate, and a non-stick layer disposed on an opposite side of the substrate. The resistive film may comprise a metal oxide or doped metal oxide. The non-stick layer may comprise polytetrafluoroethylene. One or more electrically insulating layers can be disposed between the resistive film and the substrate or on the top side of the substrate. The heating assembly may also comprise electrically conductive electrodes in electrical association with the resistive film, the electrodes preferably comprising a cermet-based silver thick film material. The substrate may comprise porcelainized carbon steel, porcelainized ferritic stainless steel, aluminum oxide, glass ceramic designated under the trade name Ceran, $Si_3N_4$-ceramic, or combinations thereof.

In another aspect, the present invention provides a warming assembly comprising a substrate such as for example an appliance cook top, a thin electrically resistive film in thermal association with the cook top, and at least two electrically conductive electrodes in electrical association with the resistive film. The appliance cook top may comprise a glass ceramic material. One or more layers of an electrically insulating adhesive material may be disposed around the resistive film. Alternatively, various clamping assemblies can be utilized for maintaining the resistive film in thermal association with the cook top. The warming assembly may further comprise an appliance mounting channel by which the warming assembly is supported.

In yet another aspect, the present invention provides cooking appliances comprising the noted heating and warming assemblies. In one embodiment, an appliance is provided comprising a planar heating or warming assembly that provides a cooking surface, an enclosure for supporting and containing the assembly, and a controller for adjusting and maintaining the temperature of the assembly. In another embodiment, an appliance is provided that comprises a glass ceramic cook top in conjunction with the noted heating or warming assemblies. In another embodiment, an appliance is provided that utilizes one or more of the heating assemblies as heating panels disposed within an oven interior. The present invention also provides appliances utilizing the noted heating or warming assemblies in combination with conventional heating elements known in the art.

DESCRIPTION OF THE PREFERRED EMBODIMENTS

The present invention provides heating and warming assemblies that utilize a thin electrically resistive film. As referred to herein, the term "thin film" generally refers to films having a thickness from about 0.1 to about 1.0 micrometers. The term "thick film" as used herein, refers to films having a thickness from about 1.0 to about 25 micrometers. In the assemblies described herein, the term "heating assembly" generally refers to an assembly that is capable of providing a temperature of between about 200° C. and about 350° C. along its heating surface. The heating assemblies described herein may be designed and constructed so that they are operable at temperatures higher than 350° C., such as up to about 400° C. The term "warming assembly" as used herein generally refers to an assembly that is capable of providing a surface temperature between about 40° C. and about 200° C. along its heating surface.

The preferred embodiment thin film heating assemblies of the present invention generally comprise (i) a substrate, (ii) a resistive film for heat generation in thermal association with the substrate, (iii) one or more electrically conductive electrodes or bus bars in electrical association with the resistive film, and (iv) a non-stick layer disposed on the exposed surface(s) of the assembly. The preferred embodiment thin film heating assemblies may further comprise (v) one or more dielectric or electrically insulating layers disposed on one or both sides of the resistive film (ii), or on the substrate side that is opposite the substrate side facing the resistive film. In some applications, it may also be preferred to provide an electrically conductive layer on the substrate side opposite the substrate side facing the resistive film. This is described in greater detail below.

Figure 1:
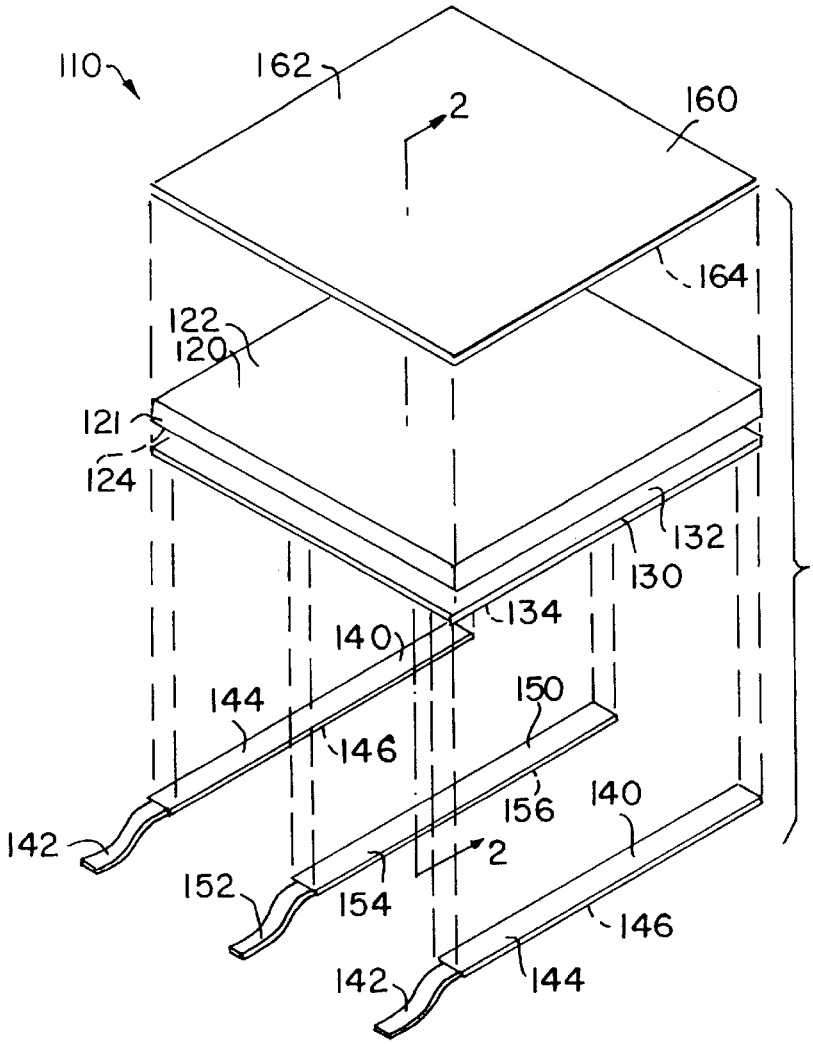
FIG. 1 is an exploded view of a first preferred embodiment thin film heating assembly in accordance with the present invention.

FIG. 1 is an exploded view of a first preferred embodiment thin film heating assembly 110 in accordance with the present invention. Before describing the particulars of the various preferred embodiments, it is to be noted that the accompanying figures are not necessarily to scale. In many of the figures, the thickness of the resistive film and other layers has been exaggerated to better illustrate the structure and relationship of the various components. In actual practice however, the resistive film may be several orders of magnitude thinner than other components of the assemblies such as for instance the substrate. This aspect is described in greater detail below. Referring to FIG. 1, assembly 110 comprises a substrate 120, one or more resistive films 130 disposed on one side of the substrate 120 and in thermal association with the substrate 120, one or more outer electrodes 140 that are in electrical association with the resistive films 130 and disposed on the same side of the substrate 120 as the resistive films 130, one or more inner electrodes 150 that are also in electrical association with the resistive films 130 and disposed on the same side of the substrate 120 as the resistive films 130 and the outer electrodes 140, and a non-stick layer 160 disposed on a side of the substrate 120 opposite the substrate side facing the resistive films 130 and the electrodes 140 and 150.

The substrate 120 is preferably planar having a first or outer (upper) face 122, an oppositely directed second or inner (lower) face 124, and a peripheral edge 121. Although the substrate 120 is depicted in FIG. 1 as rectangular in shape, it is to be understood that the substrate 120 may have nearly any shape including circular, oval, and elliptical shapes. The thickness of the substrate 120 is generally dictated by the end use requirements for the assembly 110. Typical thicknesses for the substrate 120 range from about 0.5 millimeters up to about 1 centimeter. It is preferred that the thickness of the substrate 120 is generally uniform. Although it is generally preferred that the substrate 120 is flat, it is contemplated that one or both sides of the substrate could be curved or otherwise nonplanar.

Figure 1A:
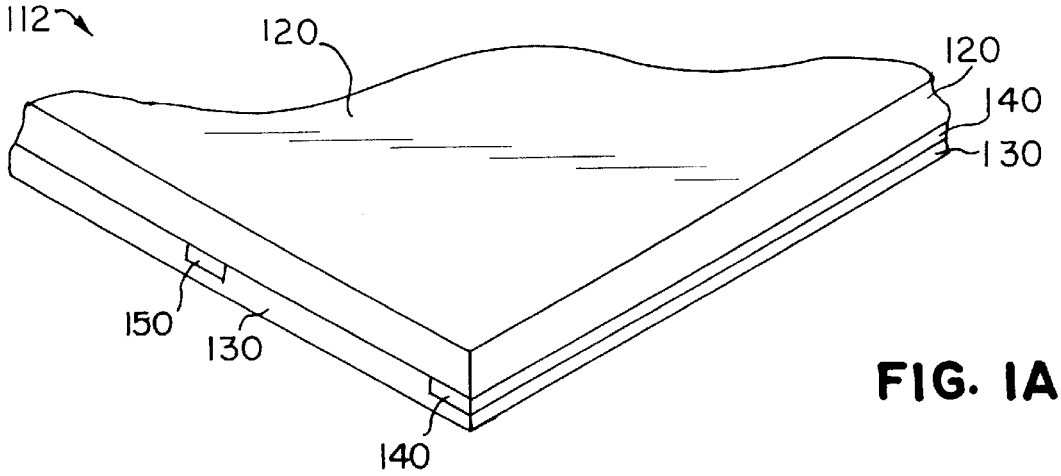
FIGS. 1A and 1B are partial perspective views of alternate preferred embodiment thin film heating assemblies.
Figure 1B:
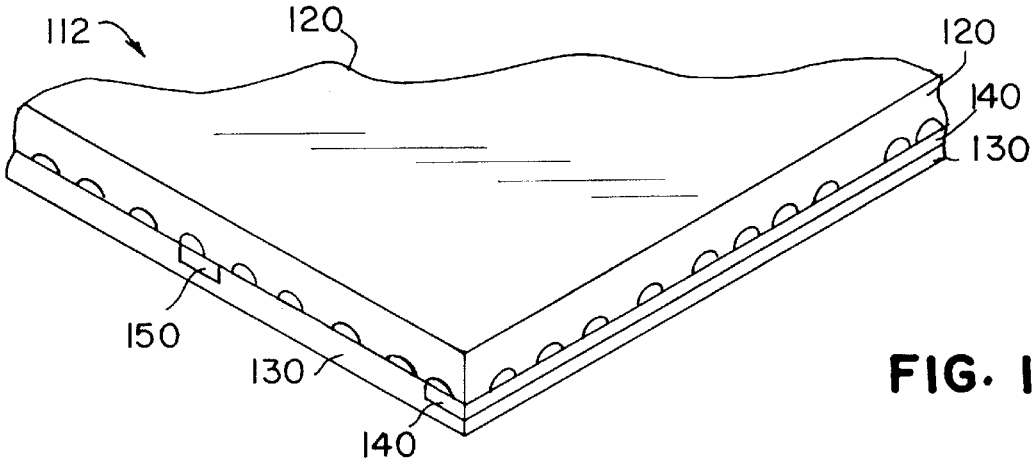

Another preferred configuration for the substrate 120 is generally planar having one finished, relatively smooth face and a second dimpled face as shown in FIG. 1B. This configuration is typical for substrates of glass ceramic, particularly those available under the designation Ceran. When a substrate having such a configuration is incorporated into the assemblies of the invention and so utilized as substrate 120 in assembly 110 for instance, the smooth face of the substrate serves as the outer or upper face 122 and the dimpled face serves as the inner or lower face 124.

The resistive films 130 each have a top surface 132 and a bottom surface 134. As noted, multiple resistive films 130 can be utilized in the present invention assemblies. It is preferred that all films 130 be disposed in the same plane. It is also preferred that the top surface 132 of each resistive film 130 be directed toward, and most preferably immediately adjacent and in contact with, the second face 124 of the substrate 120. The configuration promotes thermal conduction between the resistive films 130 and the substrate 120. It is also preferred that the entirety or at least a majority of the surface area of the second face 124 be covered by the resistive films 130. Accordingly, the collective shape resulting from the resistive films 130 is preferably similar to the shape of the substrate 120. The preferred thickness for the resistive films 130 is described below.

The outer electrodes 140 and inner electrodes 150 are preferably straight or linear and oriented parallel with the plane of the substrate 120. The electrodes 140 and 150 are preferably thin strip-like elements having a length dimension significantly greater than their width dimension. The thickness of each electrode 140 and 150 is preferably from about 5 to about 25 micrometers. Each outer electrode 140 includes an electrical lead or termination 142, a top face 144, and a bottom face 146. Each inner electrode 150 includes an electrical lead or termination 152, a top face 154, and a bottom face 156. Although FIG. 1 illustrates the outer electrodes 140 as disposed alongside and adjacent an outer edge of the assembly 110, it is to be understood that one or more, or all of the outer electrodes 140 could be disposed near an intermediate region of the assembly 110. Similarly, other configurations for the inner electrodes 150 and the combination of the inner electrodes 150 and the outer electrodes 140 are contemplated.

Referring to FIG. 1A, the present invention includes a wide array of configurations and arrangements for the resistive film 130 and the electrodes 140 and 150. For instance, as shown in FIG. 1A, the electrodes 140 and 150 of an alternate assembly 112 can be disposed immediately adjacent the substrate 120, and the resistive film 130 disposed and overlying not only the substrate 120 but also the electrodes 140 and 150. Additional aspects of the preferred embodiment electrodes 140 and 150 are discussed below.

As shown in FIG. 1, the non-stick layer 160 includes an outwardly facing surface 162 and a second surface 164. The outwardly facing surface 162 preferably constitutes the exposed heating surface of the assembly 110. The second surface 164 is preferably disposed immediately adjacent and in contact with the first face 122 of the substrate 120.

The assembly 110 is preferably powered by appropriate connection to an electrical power source, such as a three-wire 220 volt supply. Assembly 110 is connected to such a source by connecting the outer electrodes 140 to a respective hot line, e.g. $H_1$ or $H_2$, and if desired, an inner electrode 150 can be connected to ground or neutral, e.g. N. The assembly 110 can also be appropriately connected to other three-wire systems, or to two-wire systems.

Figure 2:
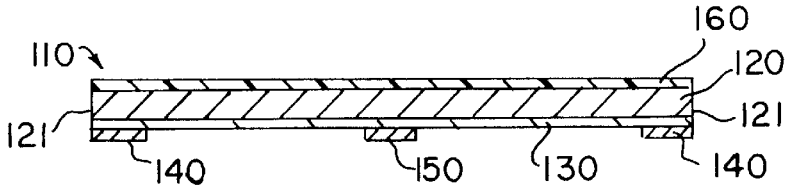
FIG. 2 is a cross-sectional view of the first preferred embodiment thin film heating assembly taken along line 2—2 in FIG. 1 after fabrication.

FIG. 2 is a cross-sectional view of the first preferred embodiment thin film heating assembly 110 taken along line 2—2 shown in FIG. 1. As illustrated in FIG. 2, it is preferred that the resistive films 130 are disposed underneath and immediately adjacent the substrate 120. The resistive thin films 130 are electrically connected to the electrodes 140 and 150 by disposing the electrodes directly on top, or underneath, the thin films 130.

Figure 2A:
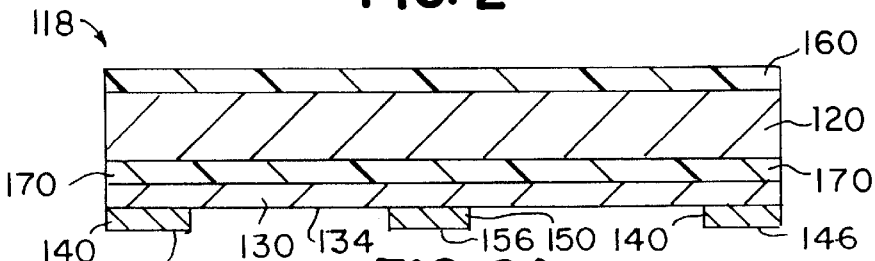
FIG. 2A is a cross-sectional view of another preferred embodiment thin film heating assembly.

FIG. 2A is a cross-sectional view of another preferred embodiment thin film heating assembly 118 in accordance with the present invention. The thin film heating assembly 118 comprises the previously described substrate 120, resistive films 130, one or more outer electrodes 140, one or more inner electrodes 150, and the non-stick layer 160. The assembly 118 further comprises a dielectric or electrically insulating layer 170 disposed between the substrate 120 and the layer of the resistive films 130. Alternatively or in addition, the electrically insulating layer 170 can be disposed on the bottom surface 134 of the resistive films 130. The electrically insulating layer 170 has a size and shape sufficient for it to cover, or substantially so, the components upon which it is disposed. Typically, the components upon which the electrically insulating layer 170 is disposed include the substrate 120, the resistive films 130, the outer electrodes 140, and the inner electrode 150. Alternatively or in addition, the electrically insulating layer 170 may be disposed on the substrate side opposite the substrate side facing the resistive film, i.e. side 122. The thickness of the electrically insulating layer 170 primarily depends upon the electrical insulation properties, i.e. the volume resistivity and dielectric constant, of the material forming the layer 170, and the electrical operating characteristics of the thin film heating assembly 118. The thickness of the layer 170 may also vary depending upon the particular application, but should in all cases, be sufficiently thick to prevent electrical current loss or short circuiting of the resistive films 130, the outer electrodes 140, and the inner electrodes 150. As described in greater detail below, it may in some applications be preferred to provide an electrically conductive layer on the outermost top surface of the assembly. This layer may be in addition to, or replace, the layer 170 when layer 170 is disposed on the substrate side opposite the substrate side facing the resistive film.

The preferred materials for the various components of preferred heating assemblies in accordance with the present invention are as follows. The substrate (i) can be nearly any heat resistant, relatively rigid material. The material selected for the substrate (i) should also exhibit electrical insulating properties or be coated or otherwise treated to have such property. The material selected for the substrate (i) should have a relatively low coefficient of thermal expansion. Examples of materials suitable for use as the substrate (i) include, but are not limited to, porcelainized carbon steel, porcelainized ferritic stainless steel, aluminum oxide, glass ceramic commonly referred to as Ceran, $Si_3N_4$-ceramic, and combinations of the foregoing. A particularly preferred material for the substrate is glass ceramic. A preferred glass ceramic is $Li_2Al_2Si_2O_6$ beta-quartz (LAS), such as available from Eurokera or Schott. If a porcelainized steel is selected for use as the substrate (i), it should be free of alkali and alkali earth metals so as to maintain good electrical insulating properties at temperatures above 150° C. A supplier of such porcelainized steel substrates is Ferro. Glass ceramic is generally preferred since as compared to other substrates, glass ceramic exhibits a relatively low thermal shear stress. The coefficient of thermal expansion of glass ceramic is essentially zero as compared to steel having a coefficient of thermal expansion of about 11 ppm. The use of near zero thermal expansion glass ceramic significantly reduces the tendency of crazing and cracking of other layers or films deposited on the glass substrate such as tin dioxide.

The electrically resistive film (ii) can be a thin film of metal oxide such as for instance tin dioxide, a cermet-based thick film material, a polymer-based thick film material, or any type of electrically resistive film or coating. It is preferred that the resistive film (ii) is a thin film of metal oxide, and most preferred that the metal oxide thin film be a doped tin dioxide thin film. A preferred dopant for tin dioxide is 0.1 to 0.5 weight percent fluorine. It is also preferred that the metal oxide thin film be deposited on a face of the substrate (i) by an atmospheric chemical vapor deposition (ACVD) process. One preferred metal oxide for example, is tin dioxide thin film doped with approximately 0.4 weight percent fluorine, and applied by an atmospheric chemical vapor deposition process at approximately 550° C. It is contemplated that other techniques for depositing the resistive film (ii) could be utilized. For instance, liquid materials or resistive film precursors could be applied by spraying and if necessary followed by additional spray coatings, exposure to heat or radiation, or other operations depending upon the end use application.

The material utilized for forming the resistive film (ii) has a positive temperature coefficient (PTC) with respect to its electrical resistance. When utilizing a metal oxide such as tin oxide, the temperature coefficient of resistance may be adjusted by adding appropriate amounts of oxides of iron, cobalt, nickel, niobium, tantalum, zirconium, and hafnium. It is important that the resistive film (ii) exhibit a PTC so that electrical resistance of the film increases with temperature. This property prevents temperature runaway during application of electrical power to the heating assembly. It is preferable to utilize a resistive film that has a linear PTC in the range of 250 to 400° C. Doped tin dioxide exhibits this property. The resistive film (ii) should be able to accommodate a power density of between about 1.0 to about 20 $W/cm^2$ and a current density of between about 11,000 to 90,000 $A/cm^2$.

The thickness of the resistive film (ii) varies depending upon the materials utilized for the resistive film (ii) and the particular application. The preferred thickness of such films generally ranges from about 0.1 to about 0.5 micrometers for most metal oxides or doped metal oxides, including tin dioxide. The thickness of the resistive film when formed from a thick-film material, for instance a cermet-based thick film material or a polymer-based thick film material, is between about 1 and about 25 micrometers.

A tin dioxide thin film may be applied to the dimpled underside of a Ceran type glass ceramic substrate. Although not wishing to be bound to any particular theory, it is believed that superior adhesion is achieved between a thin film and a dimpled or irregular surface substrate as compared to a substrate having a smooth surface. A dimpled surface has a greater amount of surface area available for bonding than a relatively smooth surface. The increased surface area decreases the wattage or power density carried by the thin film and so, promotes reliability of the thin film. The dimpled surface also prevents or minimizes fractures of the substrate. By depositing a thin film directly on the dimpled face of a substrate, the occurrence of scratches or fissures in the thin film is reduced. Since there is essentially no tensile stress at the peaks or high points of the dimples, the propagation of cracks in the substrate and adjacent films, is significantly minimized. Depositing a thin film directly upon a dimpled surface is preferred as compared to applying a thick film cermet material or adhesive material on the dimpled surface, since deposition of a thin film does not produce differential stresses on the glass ceramic and resulting shear and fracture. Furthermore, the dimpled surface promotes gripping for an electrical edge connector used for transmission of electrical power to the thin film layer. Moreover, direct deposition of a thin film on a dimpled substrate surface avoids having to smooth or otherwise finish the dimpled surface. This will in many applications provide significant economic advantage. It may in some instances be desirable to apply an intermediate dielectric layer between the underside of the Ceran substrate and the tin dioxide film.

It is preferred that a dimpled substrate have a particular configuration as follows. For a substrate having a thickness from about 4 to about 5 millimeters, the dimpled surface preferably comprises a plurality of closely arranged dimples that project outward a distance of from about 40 to about 200 micrometers from the substrate surface. Each dimple is preferably oval shaped and oriented so that its major diameter is parallel with the longitudinal axis of the substrate. It is most preferred that all of the dimples, or at least a majority, be oriented parallel to one another and with the longitudinal axis of the substrate. The preferred major diameter for each oval is about 2.1 millimeters. The preferred minor diameter of each oval is about 1.75 millimeters. The ovals are preferably spaced from each other by about 3.4 millimeters between centerpoints of adjacent dimples as measured along their width or minor diameter, and about 2.5 millimeters between centerpoints of adjacent dimples as measured along their length or major diameter.

The electrodes or bus bars (iii) are preferably formed from a cermet-based silver thick film material. It is contemplated that other electrically conductive materials could be utilized for the electrodes (iii). The selected materials should be compatible with other materials utilized in the resulting heating assembly. A preferred material for the electrodes is a silver cermet. This preferred material is applied by screen printing. In its printable state, it comprises a carrier or solvent, glass frit, and silver particles. When deposited on a glass substrate and fired at approximately 550° C., it forms a blend with the glass substrate as a continuous phase with the silver particles dispersed therein. Silver cermet materials are available from DuPont, ESL, and Ferro for example.

The non-stick layer (iv) is preferably formed from crosslinked silicone or polytetrafluoroethylene (PTFE) impregnating a porous scratch resistant structure like flame sprayed stainless steel. Various crosslinked silicone compositions may be utilized for the non-stick layer (iv).

The optional dielectric layer (v) is preferably any electrically insulating material that is suitable for exposure to relatively high temperatures, such as generated by the heating assemblies described herein. Examples of such materials include silicone dioxide, titanium dioxide, inorganic high temperature cements, sealing glasses, sol gel applied ceramics such as zirconia applied as a sol gel, high temperature paint, plasma or flame sprayed ceramics, or combinations thereof. The dielectric material selected preferably has a coefficient of thermal expansion as close to the substrate (i) as possible. A specific example of a preferred material for the dielectric layer is a glass layer fused to a glass ceramic substrate. Such fusing can be performed at temperatures in the range of 600° C. to 850° C. Another specific example of a preferred material for the dielectric layer is a thin film of titanium dioxide $TiO_2$. This can be applied via atmospheric chemical vapor deposition. A further specific example of a preferred material for the dielectric layer is a ceramic material, for instance an alumina-based ceramic material, that is plasma sprayed or HVOF sprayed. Another specific example of a preferred material is zirconium dioxide ($ZrO_2$) that is applied as a sol gel.

The optional dielectric layer (v) can be incorporated into any of the heating or warming assemblies described herein. Multiple dielectric layers may be utilized where necessary. A preferred location for incorporating one or more electrically insulating layers in the assemblies described herein is between the electrically resistive film (ii) and the substrate (i) and on the upper substrate side.

As noted, the present invention includes assemblies comprising a top or outermost layer of an electrically conductive material. It may in some applications, be desirable to provide an electrical connection between that top electrically conductive material and an electrical ground. A preferred material for this top electrically conductive grounding layer is ACVD fluorine doped tin dioxide ($SnO_2$) thin film having a thickness of from about 0.1 to about 0.5 micrometers, or an Invar-alloy film, for example Fe—Ni, having a thickness of from about 0.1 to about 10 micrometers.

Any or all of the electrode or bus bars (iii), the non-stick layer (iv), and/or the dielectric layer (v), and the optional safety ground layer can be formed by screen printing techniques, spray coating operations, or other suitable techniques depending upon the characteristics of the starting materials. For applications in which the electrodes or bus bars (iii) are formed from an initially flowable material, such as thick film paste materials, it is preferred to screen print the electrode material directly onto the surface of interest. This enables formation of any desired arrangement or pattern of electrodes or bus bars in a simple and economical fashion.

The coefficient of thermal expansion (CTE) of components (i)–(iv) and optional dielectric layer (v) and safety ground layer is preferably closely matched. Careful selection of the materials utilized for components (i)–(iv) and the noted optional layers, and appropriate matching of their respective thermal expansion characteristics ensure that the resulting assembly will exhibit high durability and minimal failure occurrences.

A preferred combination of materials for the various components is as follows. The substrate (i) preferably comprises a glass ceramic. The resistive film (ii) is preferably formed from doped ACVD tin dioxide. A cermet-based silver thick film is utilized for the electrodes or bus bars (iii). The non-stick layer (iv) consists of crosslinked silicone or PTFE impregnating a porous scratch resistant structure like flame sprayed stainless steel or plasma sprayed ceramic.

Heating by the thin film heating assemblies, such as assembly 110, is performed by passing electrical current through the resistive film 130. This is preferably achieved by electrically connecting the electrical leads 142 to a voltage source. A controller can be used to regulate the flow of electric current to control the temperature of the resistive film or the heating assembly. If utilizing doped tin oxide for the resistive film (ii), the linear PTC characteristic of that material enables direct temperature control by monitoring the change in current versus temperature change.

Figure 3:
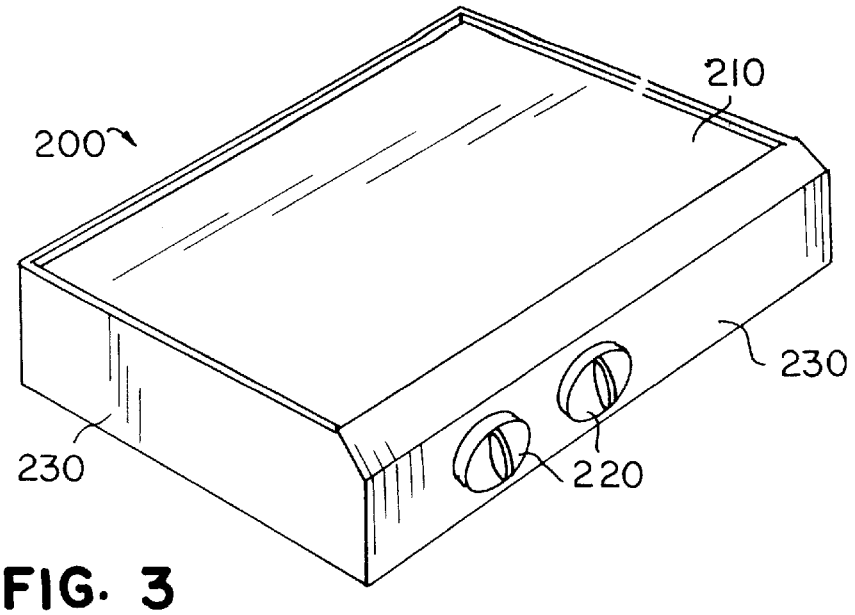
FIG. 3 is a perspective view of a heating device utilizing a thin film heating assembly in accordance with the present invention.

The present invention also provides appliances that employ the previously described thin film heating assemblies. FIG. 3 illustrates a griddle 200 comprising a thin film heating assembly 210, one or more controls 220, and an enclosure 230. The thin film heating assembly 210 is preferably similar to the previously described heating assemblies. The heating assembly 210 is incorporated within the enclosure 230 by techniques known to those skilled in the art.

Figure 4:
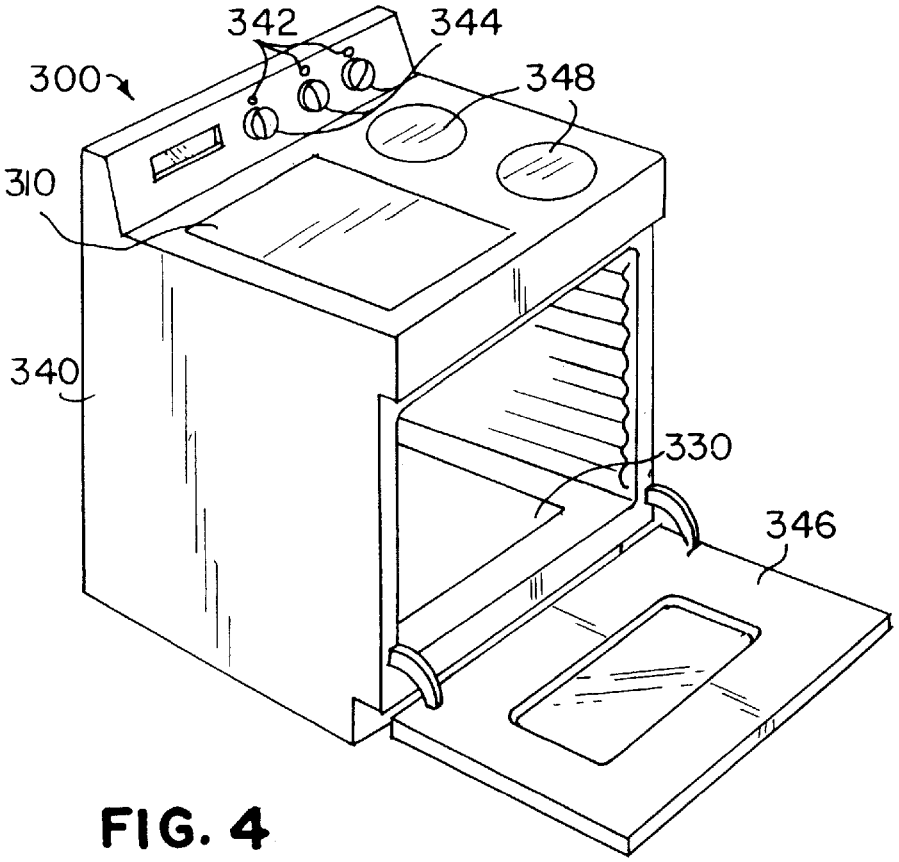
FIG. 4 is a perspective view of a range utilizing a plurality of thin film heating assemblies in accordance with the present invention.

FIG. 4 illustrates a domestic range 300 comprising a plurality of thin film heating assemblies in accordance with the present invention. The range 300 comprises a planar, relatively large surface area griddle 310 utilizing a thin film heating assembly such as the previously described heating assembly 210. Moreover, the range 300 may comprise one or more oven heating panels 330 disposed in the lower portion of the range 300 that employ the thin film heating assembly of the present invention. These oven heating panels 330 are described in greater detail below. The range 300 may utilize any combination of the griddle 310 and the oven heating panels 330. The range 300 may further comprise one or more heating element elements 348 in the form of conventional electrical resistance elements known in the art, or in accordance with the present invention thin film heating assemblies. The range 300 generally comprises an enclosure 340, a door 346 pivotally attached thereto, and indicators and electronic controls 342 and 344 respectively, for monitoring and controlling the operation of the griddle 310, the oven heating panels 330, and the heating element elements 348.

The thin film heating assembly of the present invention is particularly well suited for use as an oven heating panel that can supplement and most preferably replace conventional oven baking elements. Replacing conventional oven baking elements with the heating assembly of the present invention provides an oven that is significantly easier to clean. The non-stick outer surface of a thin film heating assembly that is incorporated into an oven heating panel and elimination of conventional baking elements facilitate cleaning the oven after use. Replacement of conventional baking elements with a heating panel utilizing the thin film heating assembly increases the effective oven volume. Moreover, replacement of conventional baking elements with a heating panel utilizing the thin film heating assembly results in energy savings and promotes temperature uniformity within the oven interior.

Referring to FIG. 4, the oven heating panels 330 can be disposed along any wall or portion thereof within the oven interior. Preferably, one or more oven heating panels are disposed along the rear wall of the oven interior. Similarly, one or more oven heating panels are located on the bottom wall of the oven interior, preferably replacing a conventional lower baking element. Likewise, one or more oven heating panels are located on the top wall of the oven interior, preferably replacing a conventional upper heating element such as a broiling element. It is also contemplated to incorporate one or more heating panels on the inward facing surface of the oven door 346. All of the noted oven heating panels could be employed in any combination. Thus, the present invention includes a range or oven comprising a plurality of oven heating panels 330 disposed on any combination of surfaces defining the oven interior. It is also contemplated that a plurality of oven heating panels 330 may be located on a single wall or common surface of the oven interior. This may be desirable so that exposed non-covered portions of the underlying wall such as between spaced apart adjacent oven heating panels 330, can provide mounting or support provisions for oven racks, rotisserie components, lights, viewing windows, or other items. The shape of the oven heating panels is not critical.

Figure 4A:
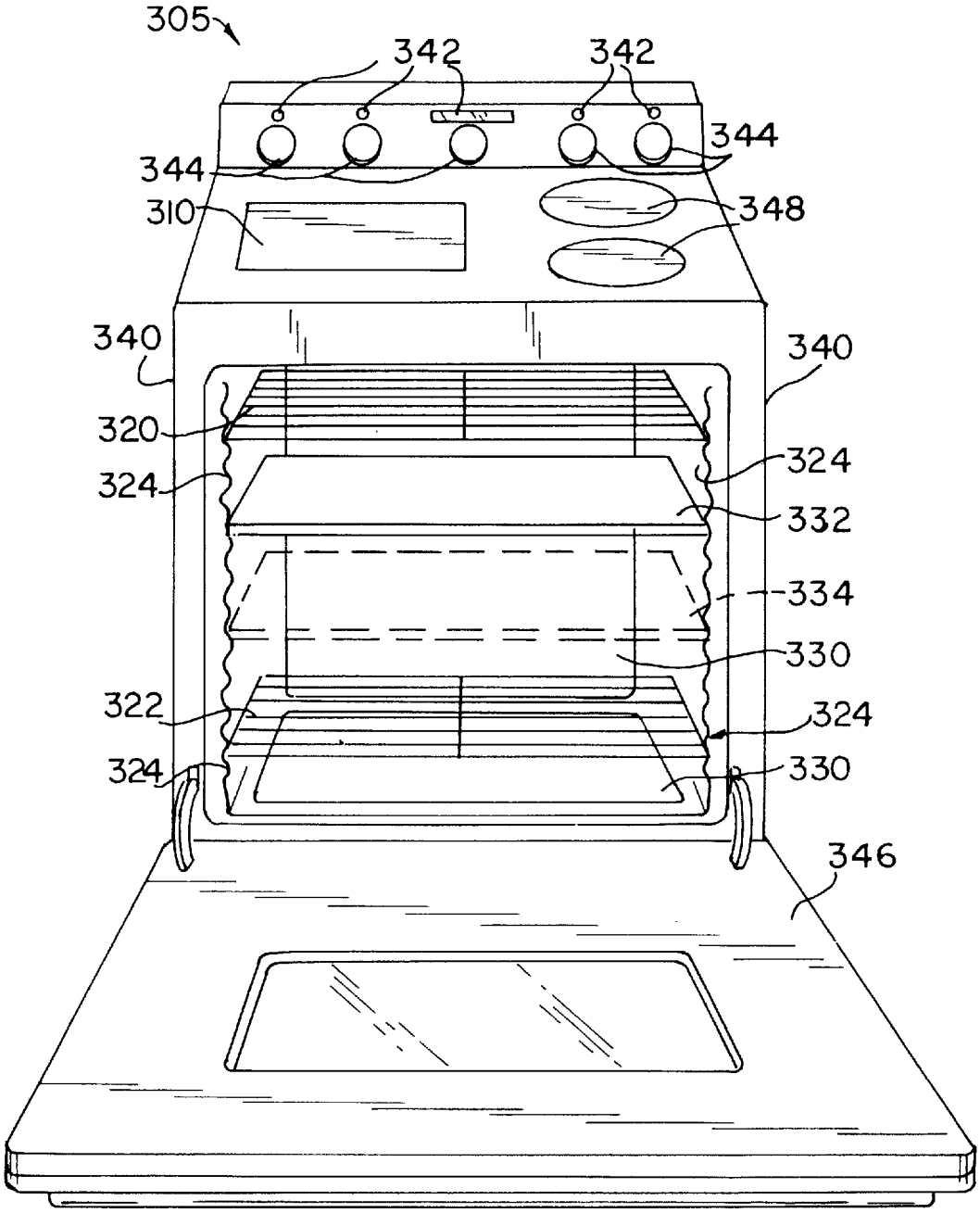
FIG. 4A is a front perspective view of a range illustrating a selectively positionable thin film heating assembly in accordance with the present invention.

It is also preferred that the oven heating panels be provided as movable panels that can be oriented or positioned within the oven interior in any desired configuration. Thus, in an alternate preferred embodiment, a range comprises a plurality of oven heating panels disposed in the lower portion of the oven interior. At least one of the oven heating panels is adapted to be selectively positioned to different locations within the oven interior, much like an oven rack may be placed at various locations within the oven interior. FIG. 4A illustrates an alternate preferred embodiment range 305 comprising one or more selectively positionable oven heating panels 332. The range 305 preferably comprises many of the same components as previously described with respect to the range 300 shown in FIG. 4, such as the griddle 310, one or more oven heating panels 330, one or more heating element elements 348, an enclosure 340, a door 346, one or more indicators 342, and one or more controls 344. The range 305 further comprises a selectively positionable oven heating panel 332 that can be placed at various locations within the oven interior. The range 305 will typically include one or more upper racks 320 disposed near the upper portion of the oven interior, and one or more lower racks 322 disposed near the lower portion of the oven interior. As evident in FIG. 4A, it is preferred that the interior side walls of the oven provide horizontally extending support ridges or ledges 324 for supporting an upper or lower oven rack 320 or 322, or a positionable oven heating panel 332.

The selectively positionable oven heating panels 332 can be placed at any location within the interior of the oven provided sufficient supports are provided at the desired location such as a pair of support ridges 324. This feature of a selectively positionable heating panel provides significantly greater flexibility in heating or baking operations than with conventional ovens utilizing non-positionable heating elements.

Referring further to FIG. 4A, the positionable oven heating panel 332 may be moved to a new location within the oven interior, such as location 334 depicted in FIG. 4A by dashed lines, by sliding or otherwise removing the panel 332 outward from the oven interior, as one would remove an oven rack such as upper rack 320, and then placing the panel 332 at the new location, e.g. location 334, within the oven interior.

Electrical connections are established to the selectively positionable oven heating panel 332 by known techniques. For instance, a flexible cable housed within an appropriate flexible cover or conduit, can be used to provide both electrical power and control signals to the panel 332. The flexible cable may extend from a rear wall of the oven interior to a rearwardly directed edge or the underside of the panel 332. Alternately, a plurality of plug receptacles could be provided on one or more walls of the oven interior, and one or more corresponding mating receptacles provided on the panel 332 such that upon appropriate placement of the panel, such as between a pair of support ridges 324 and against the oven rear wall, the plugs are engaged thereby completing the requisite power and control circuits between the panel 332 and the range 305.

The oven heating panel 330 or 332 comprises a thin film heating assembly generally corresponding to the previously described thin film heating assemblies, and further comprises a coating or layer of suitable material adapted for exposure to the oven interior. Thus, an oven heating panel 330 or 332 can be formed by utilizing a suitable oven interior coating material known in the art as the previously described non-stick layer (iv) in conjunction with any of the previously noted preferred embodiment thin film heating assemblies.

Figure 5:
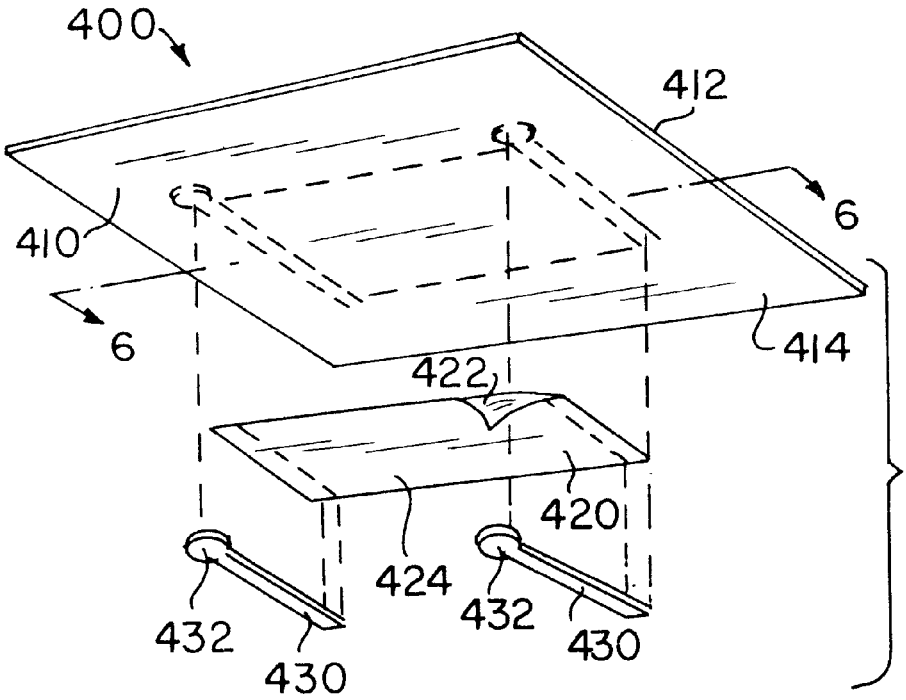
FIG. 5 is an exploded view of the underside of a first preferred embodiment thin film warming assembly in accordance with the present invention.

The present invention also provides a warming assembly comprising a thin electrically resistive film. The warming assembly is particularly well suited for providing a warming zone on a cook top and preferably a smooth planar cook top such as used in modern ranges and cooking appliances. FIG. 5 is a perspective view of the underside of a first preferred embodiment thin film warming assembly 400 in accordance with the present invention. The assembly 400 comprises a cook top 410, a thin electrically resistive film 420 disposed on the underside of the cook top 410, and one or more bus bars 430 in electrical association with the resistive film 420. The cook top 410 has a top heating surface 412 upon which is typically placed containers or food items to be heated or warmed, (and a cook top underside 414. The cook top 410 is preferably a glass ceramic cook top as known in the art. The resistive film 420 corresponds to the thin film 130 of the previously described thin film heating assemblies. The resistive film 420 is preferably tin dioxide. The resistive film 420 has an upper surface 422 and a lower surface 424. The resistive film 420 is preferably deposited on the underside of the cook top 410 such that the upper surface 422 of the resistive film 420 is in contact with the cook top underside 414. The bus bars 430 correspond to the previously described electrodes 140 and 150. The bus bars 430 are preferably formed from a cermet-based thick film. Each bus bar 430 comprises a termination pad 432 at which external electrical connections to the bus bar 430 are established.

Figure 6:
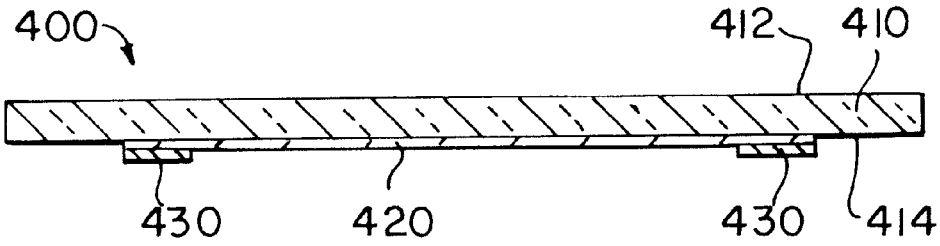
FIG. 6 is a cross-sectional view of the first preferred embodiment thin film warming assembly shown in FIG. 5 taken along line 6—6.

FIG. 6 illustrates a cross-sectional view of the first preferred embodiment thin film warming assembly 400 shown in FIG. 5 taken along line 6—6. Again, it will be appreciated that the illustration is not necessarily to scale. It is to be understood that although FIGS. 5 and 6 depict the resistive film 420 in a stacked or overlying relationship with the bus bars 430, alternate configurations are included in the present invention.

Figure 7:
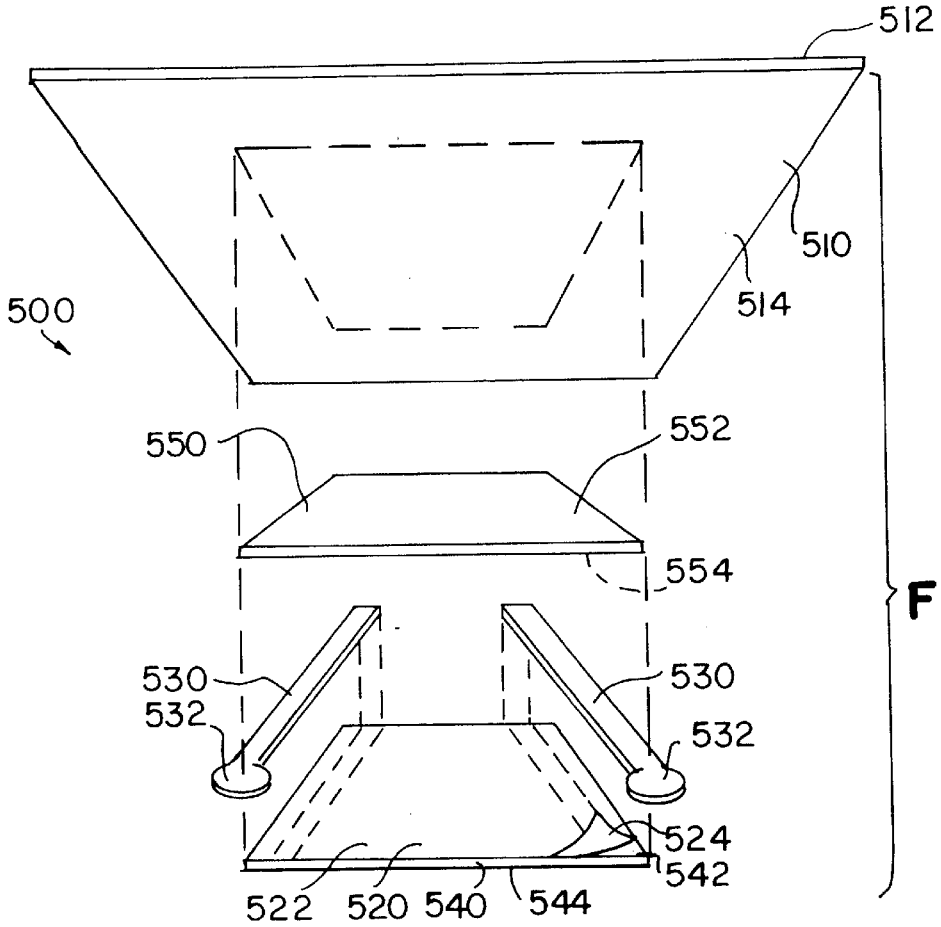
FIG. 7 is an exploded view of a second preferred embodiment thin film warming assembly in accordance with the present invention.

The present invention warming assembly also includes embodiments in which the electrically resistive heating film is secured to or deposited upon a substrate, and the resulting assembly then joined or otherwise brought into heat transfer relationship with a cook top. FIG. 7 is an exploded view of a second preferred embodiment of a thin film warming assembly 500 having such a configuration. The assembly 500 comprises a cook top 510 similar to the previously described cook top 410. The cook top 510 provides a top cooking, heating, or warming surface 512 and an underside surface 514. The assembly 500 further comprises a substrate 540 and a resistive film 520 deposited or otherwise disposed thereon. The substrate 540 corresponds to the previously described substrate 120, and provides a first face 542 and a second face 544. The resistive film 520 corresponds to the previously described resistive film 130, and includes an upper surface 522 and a lower surface 524. The assembly 500 further comprises an adhesive layer 550 disposed between the cook top 510 and the resistive film 520 for securing and maintaining those components in heat transfer relationship with each other. The adhesive layer 550 includes a top surface 552 and a bottom surface 554. Most preferably, the adhesive layer 550 is disposed between the underside 514 of the cook top 510 and the upper surface 522 of the resistive film 520. The adhesive layer 550 can be formed from nearly any adhesive suitable for the end use conditions for the assembly 500. Preferably, the adhesive used for the adhesive layer 550 is a heat conductive, heat resistant, two component silicone elastomer. It is also contemplated that appropriate heat resistant one component silicone elastomer compositions may be used. Most preferably, the adhesive layer 550 is electrically insulating. The assembly 500 also comprises one or more bus bars 530 in electrical association with the resistive film 520. The bus bars 530 each provide a termination area 532 and correspond to the previously described electrodes 140 and 150. The bus bars 530 are preferably disposed alongside or adjacent two opposite edges of the resistive film 520 as shown in FIG. 7. Other affixment techniques besides the use of adhesives could be employed for securing the resistive film 520 to the cook top 510. It will be appreciated that although FIG. 7 illustrates the resistive film 520 in a stacked or overlying relationship with the bus bars 530, alternate configurations are included in the present invention.

Figure 7A:
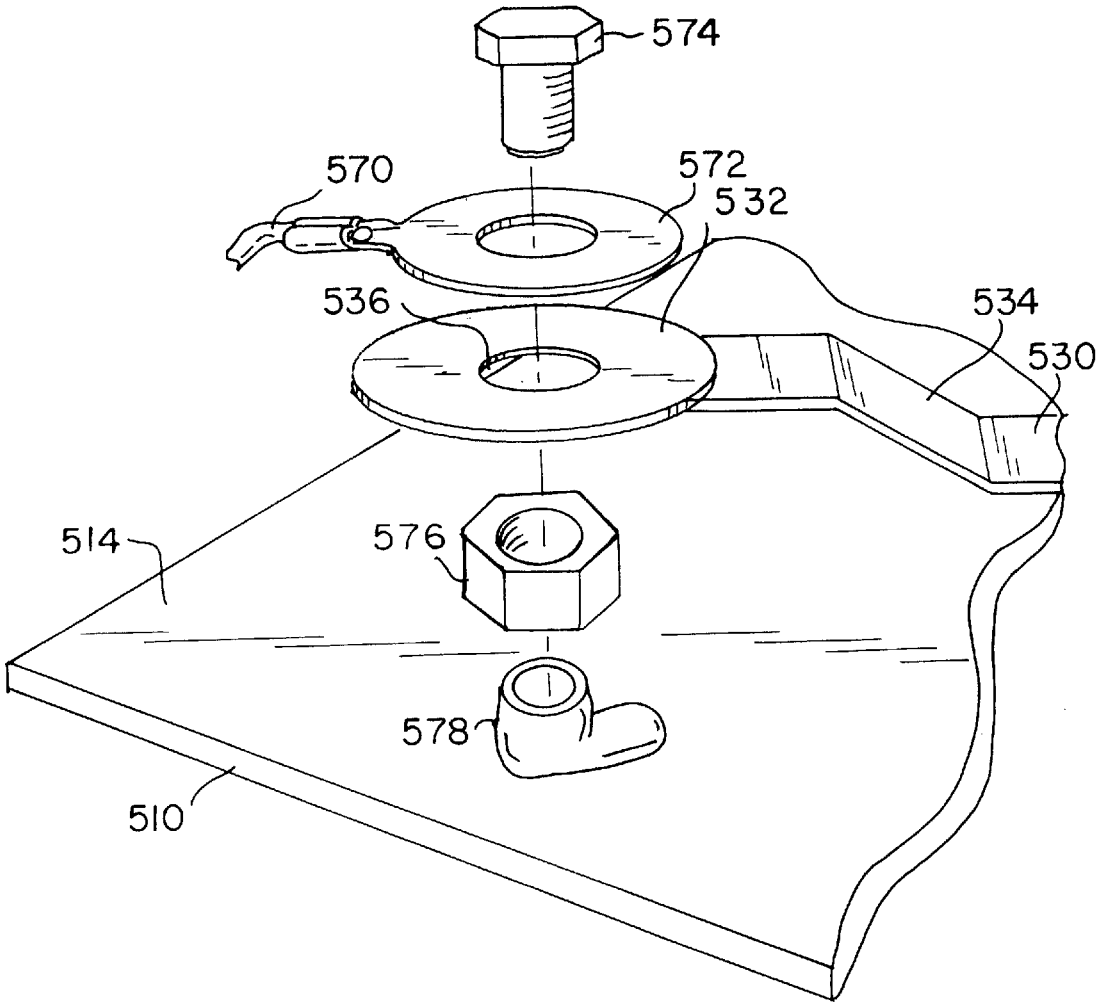
FIG. 7A is a detailed view of a first preferred end connection at a bus bar utilized in the thin film warming assembly illustrated in FIG. 7.

FIG. 7A is a detailed exploded view of a preferred end connection at a bus bar 530 of the assembly 500 shown in FIG. 7. In this preferred end connection configuration, the bus bar 530 comprises an inclined segment 534 extending between the bus bar termination 532 and the major portion of the bus bar 530. The inclined segment 534 is angled away from the underside 514 of the cook top 510 so as to provide a clearance space between the bus bar 530 and the underside 514 of the cook top 510. One or more electrical leads 570, each providing a ring terminal 572 at their end, are connected to the bus bar 530 and specifically to the bus bar termination 532 by a threaded fastener 574 and nut 576. Upon insertion of the fastener 574 through the opening in the ring terminal 572 and an aperture 536 defined in the termination 532, and placement and engagement of the nut 576 with the fastener 574, an electrically insulating end cap 578 is preferably disposed over the end of the fastener 574. The end cap 578 can be formed from nearly any electrically insulating flexible material. A heat resistant silicone rubber tubing has been found useful for the end cap 578.

Instead of utilizing a threaded fastener and nut assembly as shown in FIG. 7A, it is also within the scope of the invention to utilize a rivet connection between an electrical lead, such as lead 570 in FIG. 7A, and the bus bar termination 532. It is also contemplated that the bus bar or electrode could be disposed immediately adjacent to the substrate or cook top instead of being spaced therefrom as shown in FIG. 7A. An aperture is then preferably provided at the location for attachment of an electrical lead, and a fastener or rivet inserted therethrough. An electrically insulating washer or fastener can be used at the point of attachment between the electrical lead and bus bar, so that the portion of the fastener or rivet on the opposite side of the substrate is electrically isolated from the electrical lead and bus bar.

Figure 7B:
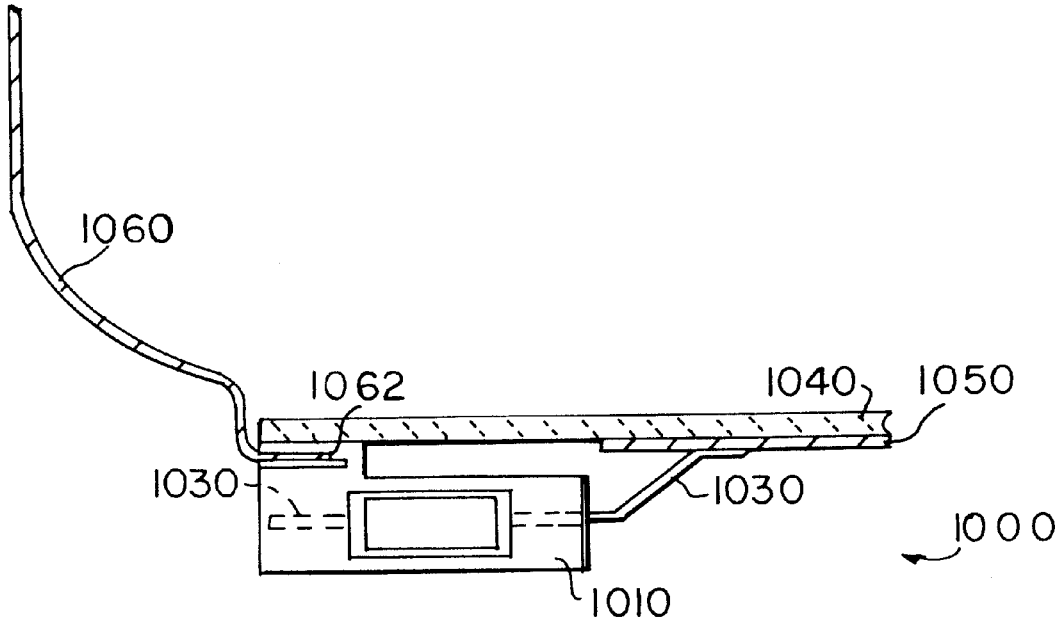
FIG. 7B is a view illustrating a second preferred embodiment electrical connector assembly in accordance with the present invention.

The present invention includes additional coupling assemblies for providing electrical connection between the thin film heating or warming assembly and the appliance, or at least the power supply leads. A second preferred embodiment electrical coupling assembly 1000 is illustrated in FIGS. 7B and 7C. The second preferred embodiment electrical coupling assembly 1000 comprises a receptacle 1010 affixed to a heating or warming assembly as described herein. FIGS. 7B and 7C illustrate the electrical coupling assembly 1000 affixed to a substrate 1040, and in electrical association with a resistive film 1050. The receptacle 1010 may be a conventional female plug coupler as known in the art and available from Amp. The receptacle 1010 provides a receiving chamber 1012 for releasably engaging a corresponding male connector. The receptacle 1010 comprises one or more electrical conductors 1030 accessible from the receiving chamber 1012. The conductors 1030 extend to, or are in electrical association with, a corresponding number of bus bars 1032, such as disposed on the underside of the resistive film 1050. The electrical conductors 1030 are preferably electrically connected to the respective bus bars 1032 at a corresponding number of termination regions 1034. All electrical connections between the conductors 1030 and the bus bar termination regions 1034 are preferably achieved by soldering. The connector assembly 1000 is utilized to selectively establish electrical connections between the heating or warming assembly and the appliance or product enclosure. The electrical connections may be for power supply connections or for control signal or electrical measurement connections.

FIG. 7B also illustrates a mounting configuration for a heating or warming assembly of the present invention. One or more enclosure panels 1060 such as constituting an appliance enclosure may be formed to provide a generally horizontal lip 1062 upon which the heating or warming assembly is mounted and affixed. Employing this mounting approach, the previously described receptacle 1010 can be affixed to the enclosure panel 1060. Other techniques for mounting a heating or warming assembly within an enclosure can be utilized including for instance threaded fasteners and rivets.

Figure 7D:
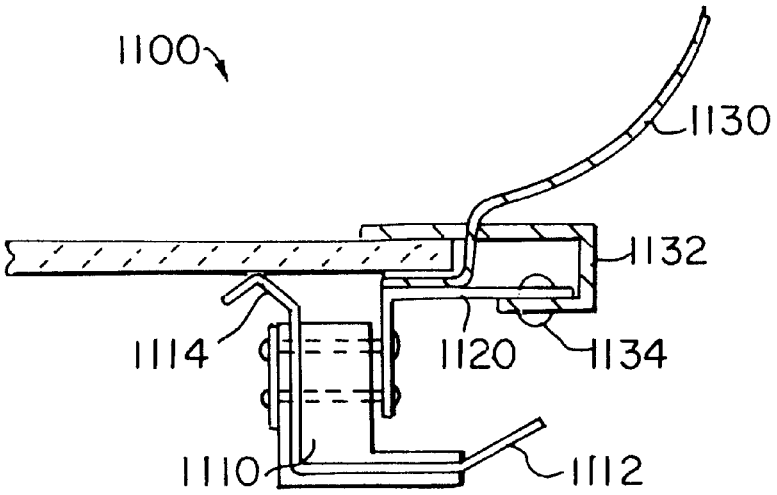
FIG. 7D is a view illustrating a third preferred embodiment electrical connector assembly in accordance with the present invention.
Figure 7C:
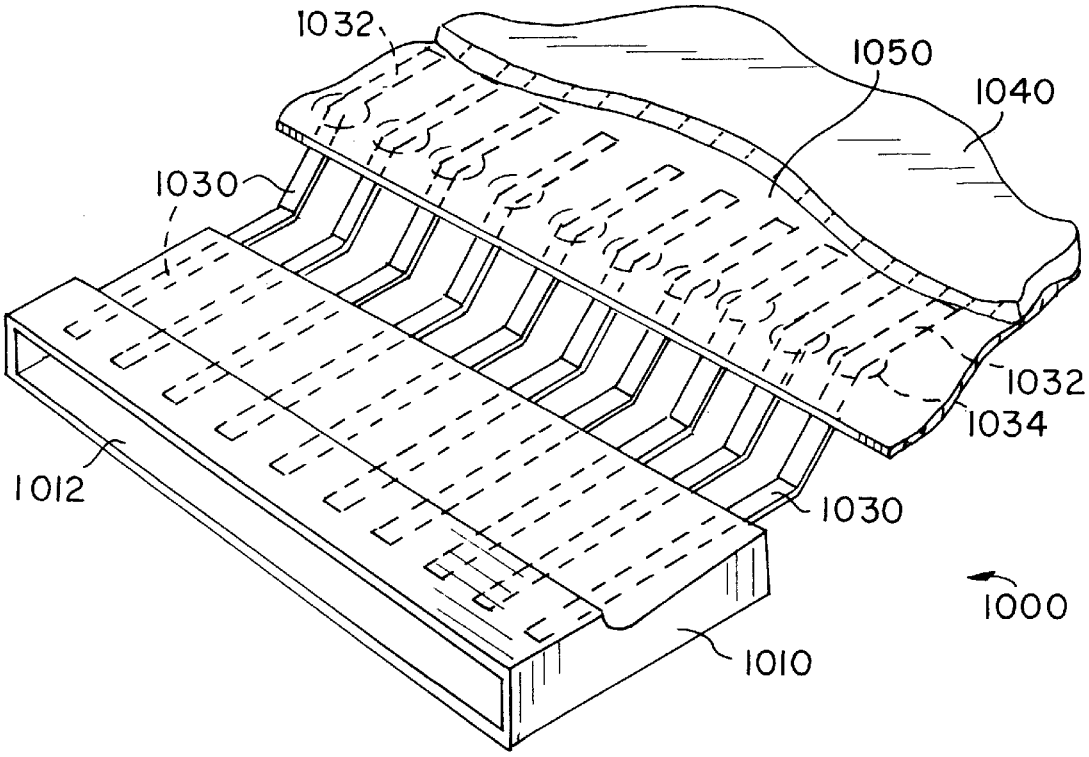
FIG. 7C is a partial perspective view of the electrical connector assembly illustrated in FIG. 7B.

A third preferred embodiment electrical coupling assembly 1100 is illustrated in FIG. 7D. This third preferred embodiment coupling assembly 1100 comprises a dual prong union member 1110 having a first projection 1112 and a second projection 1114, both projections for establishing electrical connection therebetween. The union member 1110 further has a resilient mounting member 1120 adapted for affixment to an enclosure panel 1130 or an enclosure mounting frame 1132. As shown in FIG. 7D, the union member 1110 is attached to a heating or warming assembly described herein, preferably by welding or brazing the mounting member 1120 to a peripheral edge or lip of the enclosure panel 1130 or to a region of the enclosure mounting frame 1132. The mounting member 1120 may be affixed to a heating or warming assembly by mechanical fasteners such as rivets 1134 shown in FIG. 7D. Once attached, the second projection 1114 should contact a termination region of a bus bar or other electrical component. Accordingly, electrical connection to the bus bar at the second projection 1114 is made at the first projection 1112. It is to be understood that the coupling assemblies described herein are exemplary, and the present invention heating and warming assemblies may utilize nearly any type of electrical connector to establish power, signal, or other electrical current flows to and from the heating or warming assembly.

Figure 8:
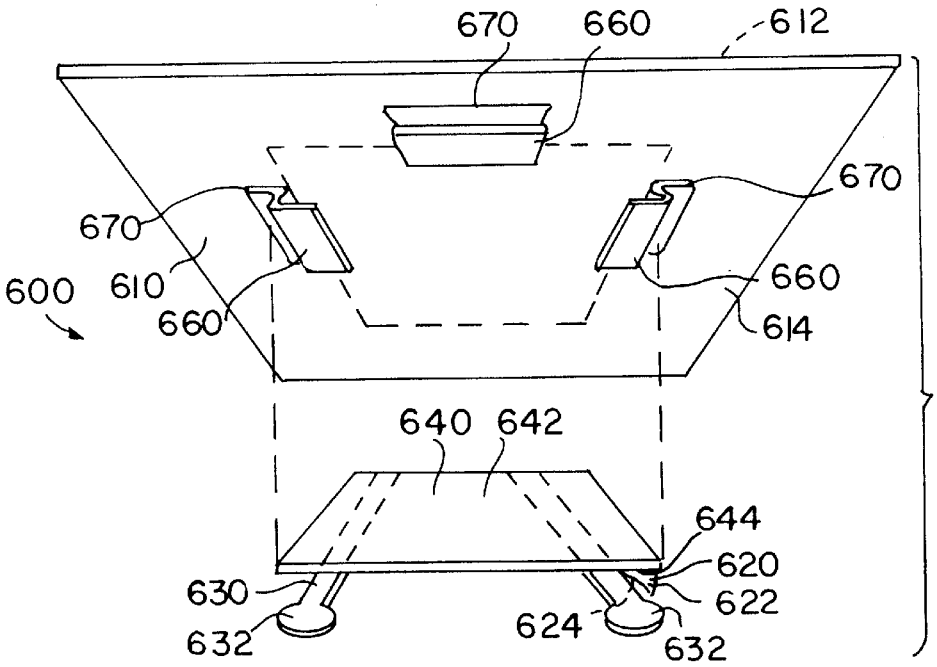
FIG. 8 is an exploded view of a third preferred embodiment thin film warming assembly in accordance with the present invention.

FIG. 8 is an exploded view of a third preferred embodiment thin film warming assembly 600 in accordance with the present invention. The assembly 600 comprises a cook top 610 similar to the previously described cook top 410. The cook top 610 provides a top cooking, heating, or warming surface 612 and an underside surface 614. The assembly 600 further comprises a substrate 640 and a resistive film 620 deposited or disposed thereon. The substrate 640 is similar to the previously described substrate 120, and provides a first face 642 and a second face 644. The resistive film 620 corresponds to the previously described resistive film 130, and includes an upper surface 622 and a lower surface 624. The assembly 600 further comprises bus bars 630 which correspond to the previously described electrodes 140 and 150. The bus bars 630 are disposed on the side of the film 620 opposite the cook top 610. The bus bars 630 are preferably disposed proximate to the opposite edges of the resistive film 620. The termination ends 632 of the bus bars 630 may also be configured as the configuration depicted in FIG. 7A. Alternatively or in addition, electrical connections can be established by the assemblies shown in FIGS. 7B–7D. The substrate 640 and resistive film 620 are affixed to and placed in thermal association with the cook top 610 by one or more clamps 660. The clamps 660 enable the assembly of substrate 640, the resistive film 620, and the bus bars 630 to be releasably engaged with the cook top 610. It is preferred to dispose at least one clamp on each peripheral edge of the substrate 640 having the film 620 disposed thereon. Each clamp 660 is preferably affixed to the underside 614 of the cook top 610 by an effective amount of an adhesive 670. The adhesive 670 is preferably a single component heat resistant silicone elastomer known to those skilled in the art. The thin film warming assembly 600 includes variant embodiments in which one or more clamps 660 are affixed to the cook top 610 by mechanical fasteners or other techniques besides the use of adhesives.

Figure 9:
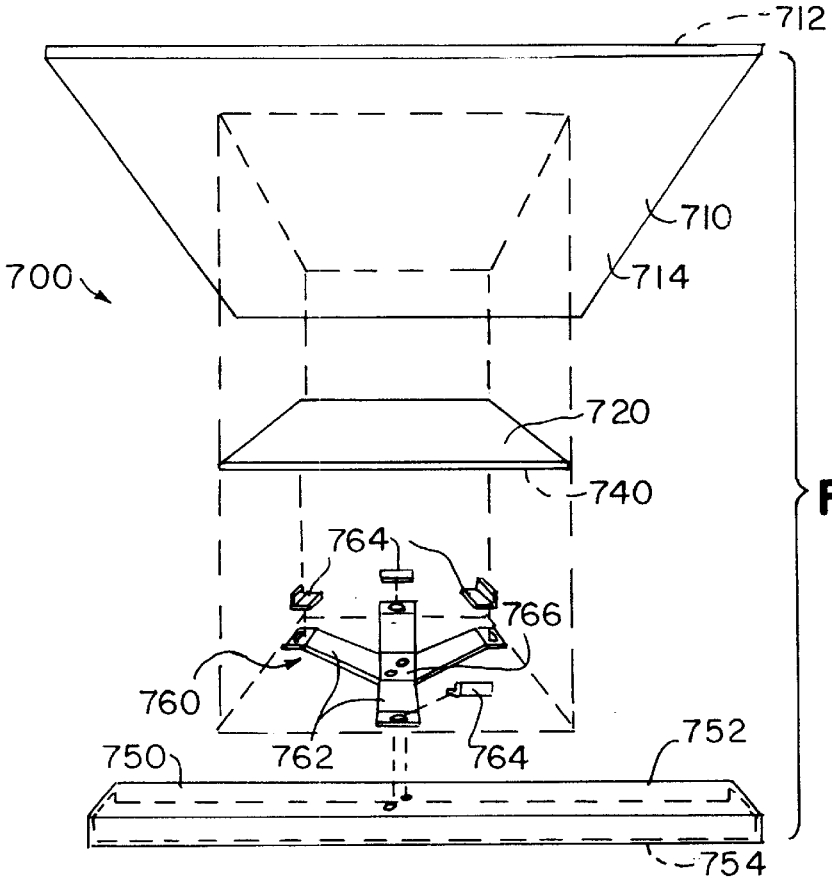
FIG. 9 is an exploded view of a fourth preferred embodiment thin film warming assembly in accordance with the present invention.

FIG. 9 is an exploded view of a fourth preferred embodiment thin film warming assembly 700 in accordance with the present invention. The assembly 700 comprises a cook top 710 similar to the previously described cook top 410. The cook top 710 provides a top cooking, heating, or warming surface 712 and an underside surface 714. The assembly 700 further comprises a substrate 740 and a resistive film 720 deposited or otherwise disposed thereon. The assembly 700 is particularly well suited for placement upon a mounting channel 750 such as provided by an appliance, the mounting channel having an upper surface 752 and a lower surface 754. The mounting channel 750 is typically horizontally disposed along an upper region in most domestic ranges or ovens. The substrate 740 and the resistive film 720 are held or secured to the cook top 710 by a bouquet spring assembly 760. The spring assembly 760 comprises one or more resilient clamping legs 762 extending radially outward from a center support member 766. Each clamping leg 762 preferably provides a separate clamping member 764 that engages the substrate 740 or connecting members projecting therefrom. Most preferably, each clamping member 764 engages an edge of the substrate 740 and prevents movement thereof. In the most preferred embodiment, the spring assembly 760 comprises four clamping legs 762, extending generally horizontally outward from a center support member 766 and spaced from each other by 900, and four corresponding clamping members 764. The distance between the clamping members 764 of opposite legs 762 is approximately the same as the respective dimension of the substrate 740 to be retained by the spring assembly 760. It is particularly preferred that the clamping members 764 are formed from an electrically insulating material. Examples of suitable dielectric materials include, but are not limited to, steatite, porcelain, or a phenolic-based polymeric material reinforced with glass fibers. As will be understood, there are numerous techniques for affixing the substrate 740, carrying the resistive film 720 thereon, to the spring assembly 760. The clamping members 764 may be attached to the substrate 740 by an adhesive or mechanical fasteners, and then the clamping members 764 affixed to the corresponding distal ends of the clamping legs 762 by adhesive or fasteners. It is also envisioned that the clamping members 764 could be integrally formed with the spring assembly 760.

Figure 10:
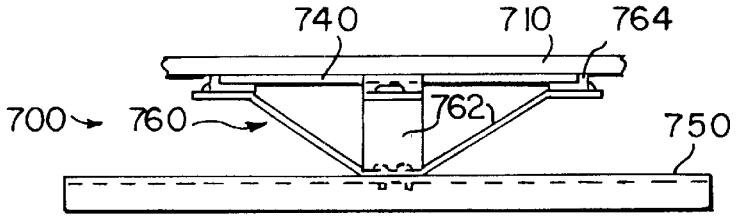
FIG. 10 is an elevational view of the fourth preferred embodiment thin film warming assembly shown in FIG. 9.

FIG. 10 is an elevational view of the fourth preferred embodiment thin film warming assembly 700 when fully assembled. Although FIGS. 9 and 10 do not explicitly illustrate the bus bars, it is to be understood that the assembly 700 comprises one or more bus bars similar to the previously described bus bars 430, 530, and 630 utilized in the assemblies 400, 500, and 600 described herein. Accordingly, the preferred connection configuration shown in FIG. 7A or others described herein may be utilized in conjunction with the bus bars for the assembly 700.

All of the previously described warmer assemblies 400, 500, 600, and 700 are preferably powered and operated via a temperature controller that regulates the temperature of the warming surface of the assembly between 40° C. and 200° C. The warmer assembly may comprise a temperature sensor to provide closed loop control.

Other electrical design consideration and aspects, applicable to many if not all of the assemblies described herein, are disclosed in U.S. application Ser. No. 08/805,508, filed Feb. 26, 1997 entitled "SOLID STATE SWITCHING CONTROL FOR LEAKAGE CURRENT CANCELLATION"; and U.S. Pat. No. 5,577,158 both owned by the same assignee of the present invention and herein incorporated by reference.

Figure 11:
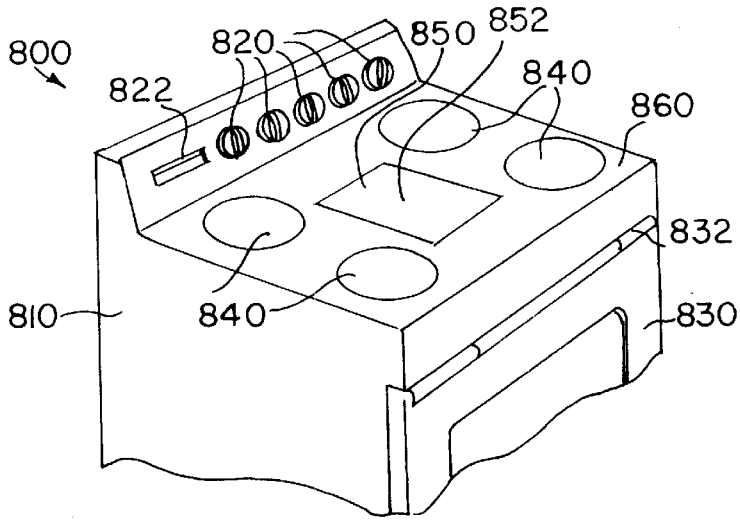
FIG. 11 is a perspective view of a range comprising a thin film warming element in accordance with the present invention.

The present invention also provides appliances utilizing the previously described warming elements. FIG. 11 illustrates a preferred embodiment range 800 comprising an enclosure 810 having a door 830 pivotally mounted thereon. The door 830 provides access to an interior chamber such as an oven (not shown). Such chamber is accessed by opening the door 830 by use of a handle 832. The range 800 may also comprise one or more controls 820 and indicators 822 as known in the art. The range 800 further comprises one or more heating elements 840 disposed upon or immediately below a cook top 860. Typically, the range 800 comprises four heating elements 840. The heating elements 840 may be in the form of conventional electrical resistance elements known in the art, or in accordance with the present invention thin film heating assemblies described herein, such as the thin film heating assemblies 110, 112, and 118. The range 800 also preferably comprises a warming element 850 that provides an upper warming surface 852. The warming element preferably corresponds to any one of the previously described warming assemblies 400, 500, 600, or 700. It is most preferred to incorporate the warming element 850 in combination with four heating elements 840 as illustrated in FIG. 11. Although the warming element 850 is shown as centrally disposed between the four heating elements 840, other configurations are included within the scope of the present invention.

Another particularly preferred heating assembly in accordance with the present invention comprises a planar substrate such as the previously described substrate 120 or cook top such as the previously noted cook top 410, 510, 610, or 710, that comprises glass ceramic of Ceran type in combination with a thin electrically resistive film of tin oxide deposited or otherwise disposed on the glass ceramic. This combination and layered configuration is well suited for use as a cooking unit in a griddle, an oven, a heating element, or as a warming element.

Although all the heating and warming assemblies described herein utilize the electrically resistive film disposed on an opposite side of a substrate or cook top from the side upon which cooking occurs, the present invention includes variations in which the resistive film is disposed on the same side of the substrate or cook top as the cooking surface.

The present invention also includes a heating or warming assembly having an outermost top layer that is electrically conductive. This electrically conductive top layer is preferably connected to an electrical ground. The use of such an electrically conductive outermost top layer connected to a ground, safeguards against accidental electrical shorting or discharge through a metal container on the assembly to an individual.

It is contemplated that one or more thermochromic materials, pigments, or inks be incorporated in one or more layers of the previously described assemblies. Preferably, such thermochromic materials would be incorporated in a dielectric top layer for a glass ceramic cook top. The dielectric layer, containing the thermochromic materials, should be confined to the heating zones and preferably, would exhibit a color change to red upon heating.

EXPERIMENTAL

A series of experiments were conducted in which the response characteristics of heating assemblies in accordance with the present invention were analyzed. In a first trial, a warmer element corresponding to the previously described warming assembly 400 was connected to an electrical power supply and the temperature measured as the assembly reached its steady state operating temperature. Table 1 set forth below indicates the relationship between the power applied and the resulting temperature as a function of time.

TABLE 1

| Power [W] | Steady State [° C.] | Time to Steady State [Minutes] | Time to 120° C. [Minutes] | Watt Density [W/cm$^2$] |
|---|---|---|---|---|
| 50 | 107 | 9.6 | | 0.25 |
| 100 | 167 | 8.9 | 4.4 | 0.51 |
| 150 | 204 | 8.1 | 2.5 | 0.76 |
| 200 | 228 | 8.1 | 2.1 | 1.02 |
| 250 | 264 | 8.2 | 1.6 | 1.27 |
| 300 | 304 | 8.0 | 1.2 | 1.53 |

It can be seen from Table 1 that in order to reach a temperature of 120° C., a typical recommended warmer temperature, within a reasonable time, i.e. about 2.0 minutes, a power density of at least 1.0 W/cm$^2$ should be used.

In a second trial, the response characteristics of a warmer according to the previously described warming assembly 700 were similarly tested. The results of that testing are set forth below in Table 2 as follows:

TABLE 2

| Power [W] | Resistance [ohms] | Voltage [v] | Steady State [° C.] | Time to Steady State [Minutes] | Time to 120° C. [Minutes] | Watt Density [W/cm$^2$] |
|---|---|---|---|---|---|---|
| 50 | 42 | 45.83 | 59.5 | 30 | — | 0.20 |
| 100 | 42 | 64.81 | 97.5 | 35 | — | 0.39 |
| 150 | 42 | 79.37 | 123.3 | 45 | 36 | 0.59 |
| 200 | 42 | 91.65 | 153.0 | 50 | 12.5 | 0.79 |
| 250 | 42 | 102.47 | 161.3 | 32.5 | 9.5 | 0.98 |
| 300 | 42 | 112.25 | 182.0 | 32.5 | 6.9 | 1.18 |

It is evident from the results presented in Table 2 that in order to reach a temperature of 120° C. in less than about 7 minutes, a power density of at least 1.18 W/cm$^2$ should be used. It is surprising and remarkable that such low amounts of power can be utilized to rapidly reach the noted temperature. Table 2 also illustrates that even at significantly lower power levels, e.g. 250W and 200W, the warming assembly reached 120° C. within relatively short time periods, e.g. 9.5 and 12.5 minutes, respectively.

In yet another trial, a heating assembly in accordance with the present invention comprising a substrate of porcelainized steel and a resistive film of tin oxide was continuously cycled at 260° C. for more than 7500 hours, without any significant change in performance. Cycling was performed at 260° C. and included energizing the heating assembly for 45 minutes followed by deenergizing the assembly for 15 minutes. It is surprising and remarkable that such cycling could be performed over such a long period of time without degradation of performance. This feat is even more remarkable since the cycling was performed at 260° C.

The present invention provides electrically powered thin film heating elements that are both reliable and serviceable. The elements provide excellent heating characteristics and performance. The elements are particularly amenable for incorporation in domestic and industrial heating or cooking appliances.

While the foregoing details are what is felt to be the preferred embodiments of the present invention, no material limitations to the scope of the claimed invention are intended. Further, features and design alternatives that would be obvious to one of ordinary skill in the art are considered to be incorporated herein. The scope of the invention is set forth and particularly described in the claims herein below.

What is claimed is:

1. An assembly for use in a cooking appliance, said heating assembly comprising:

a substrate having an upwardly directed first face and an oppositely directed second face;

a layer disposed immediately adjacent said first face of said substrate wherein said layer is an electrically conductive layer; and a thin electrically resistive film disposed immediately adjacent said second face of said substrate.

2. The assembly of claim 1 wherein said electrically conductive layer is connected to an electrical ground.

3. The assembly of claim 2 wherein the electrically conductive layer is a thin film.

4. A warming assembly for a cooking appliance, said warming assembly comprising:

an appliance cook top, said cook top having a first upwardly facing surface and a second oppositely facing surface;

a thin electrically resistive film proximate to said second surface of said cook top;

at least two electrically conductive electrodes in electrical association with said electrically resistive film;

a substrate disposed immediately adjacent to said second surface of said cook top and between said cook top and said resistive film; and a plurality of clamps affixed to said second surface of said cook top, said plurality of clamps adapted to releasably engage said substrate.

5. The warming assembly of claim 4 wherein each of said clamps engages said substrate along a perimeter edge of said substrate.

6. A warming assembly for a cooking appliance, said warming assembly comprising:

an appliance cook top, said cook top having a first upwardly facing surface and a second oppositely facing surface;

a thin electrically resistive film proximate to said second surface of said cook top;

at least two electrically conductive electrodes in electrical association with said electrically resistive film;

a substrate, wherein said resistive film is disposed immediately adjacent to said second surface of said cook top and between said cook top and said substrate; and a plurality of clamps affixed to said second surface of said cook top, said plurality of clamps adapted to releasably engage said substrate.

7. The warming assembly of claim 6 wherein each of said plurality of clamps engages said substrate along a perimeter edge of said substrate.

8. A warming assembly for a cooking appliance, said warming assembly comprising:

an appliance cook top, said cook top having a first upwardly facing surface and a second oppositely facing surface;

a thin electrically resistive film proximate to said second surface of said cook top;

at least two electrically conductive electrodes in electrical association with said electrically resistive film;

a substrate for supporting said electrically resistive film, said substrate having a first face directed toward said resistive film and a second face;

an appliance mounting channel having a first side directed toward said appliance cook top, and a second side; and a bouquet spring assembly affixed to said first side of said mounting channel and adapted to releasably engage said substrate.

9. The warming assembly of claim 8 wherein said bouquet spring assembly comprises a center support member affixed to and extending from said first side of said mounting channel, and a plurality of resilient clamping legs extending radially outward from said center support and each said clamping leg adapted for engaging said substrate.

10. The warming assembly of claim 8 wherein said bouquet spring assembly further comprises at least one electrically insulating clamping member disposed between said clamping legs and said substrate.

11. An assembly adapted for use in a cooking device, said assembly comprising:

a planar substrate comprising Ceran type glass ceramic; and a thin electrically resistive film disposed on said substrate wherein said film comprises doped tin dioxide;

an electrically conductive layer disposed on a face of said substrate opposite said thin electrically resistive film.

12. The assembly of claim 11 wherein said electrically conductive layer is connected to an electrical ground.

* * * * *

UNITED STATES PATENT AND TRADEMARK OFFICE

CERTIFICATE OF CORRECTION

PATENT NO. : 6,037,572

DATED : March 14, 2000

INVENTOR(S) : Coates et al.

It is certified that error appears in the above-indentified patent and that said Letters Patent is hereby corrected as shown below:

Col. 11, line 11, after warmed delete "(".

Col. 14, line 38, delete "900" and insert --90°--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*